United States Patent [19]

Matviak

[11] Patent Number: 4,512,580

[45] Date of Patent: Apr. 23, 1985

[54] DEVICE FOR REDUCING PREDICTABILITY IN CARD GAMES

[76] Inventor: John Matviak, R.R. #1, Box 221, Bloomsbury, N.J. 08804

[21] Appl. No.: 441,917

[22] Filed: Nov. 15, 1982

[51] Int. Cl.[3] ..... A63F 1/12

[52] U.S. Cl. ..... 273/148 A; 273/149 R

[58] Field of Search ..... 273/149 R, 149 P, 148 A

[56] References Cited

U.S. PATENT DOCUMENTS 1,909,340 5/1933 Fuller ..... 273/149 P

*Primary Examiner*—Richard C. Pinkham
*Assistant Examiner*—Leo P. Picard
*Attorney, Agent, or Firm*—Bruce M. Collins

[57] ABSTRACT

A device for maximizing the random distribution of playing cards comprises a continuous, advancable track mounted on a base and supporting the cards in a vertical orientation and at least one access station which permits either or both of removal of a portion of the cards or insertion of cards onto the track.

16 Claims, 12 Drawing Figures

DEVICE FOR REDUCING PREDICTABILITY IN CARD GAMES

DETAILED DESCRIPTION

Figure 1:
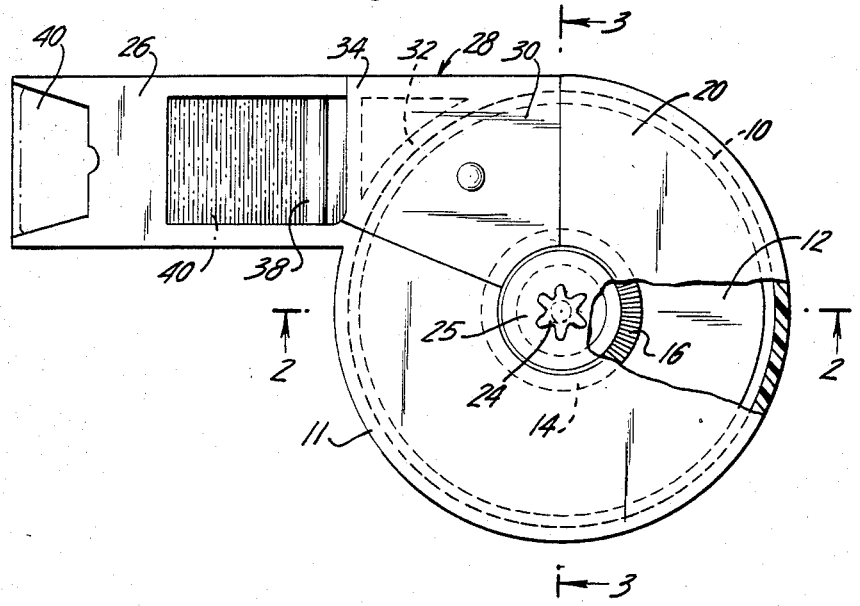
Figure 2:
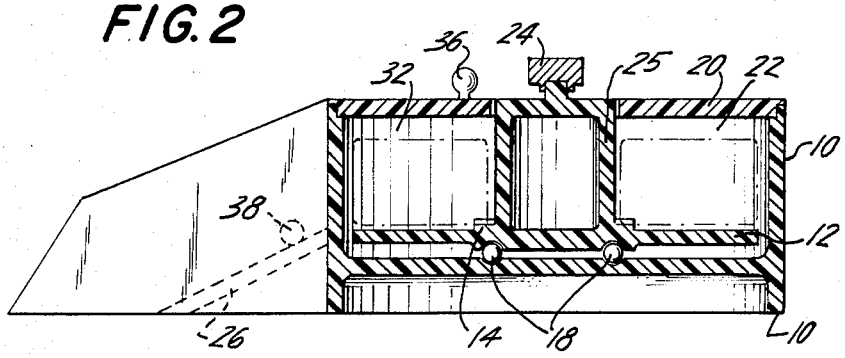
Figure 4:
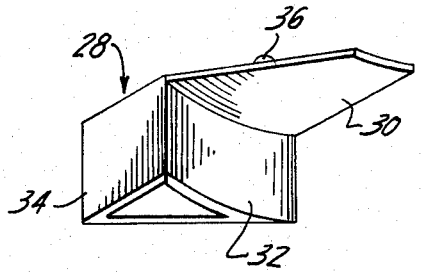
Figure 3:
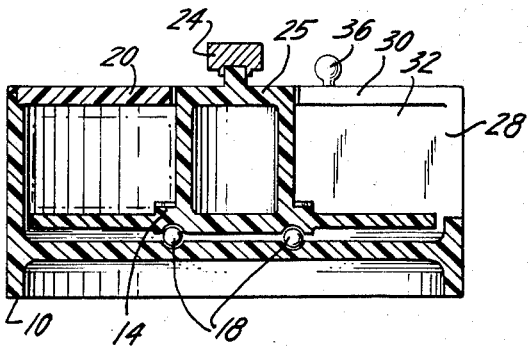
Figure 5:
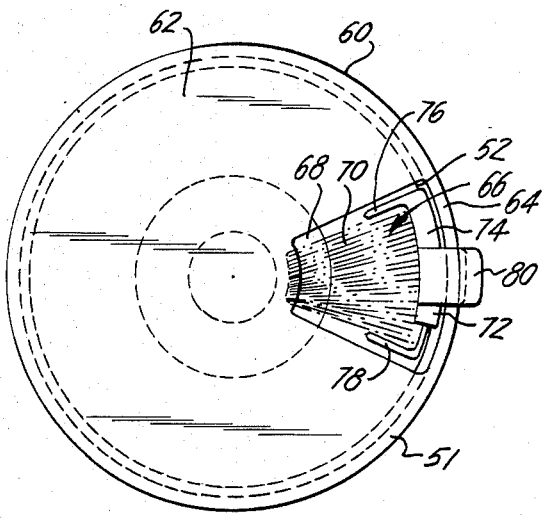
Figure 6:
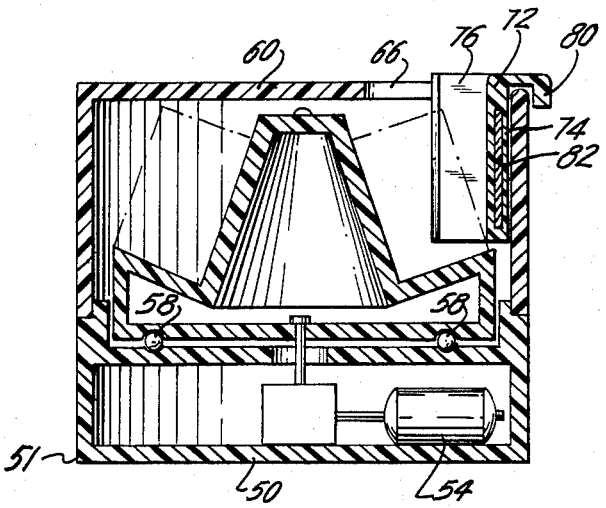
Figure 7:
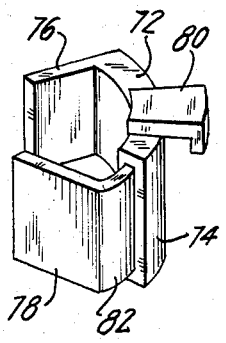
Figure 12:
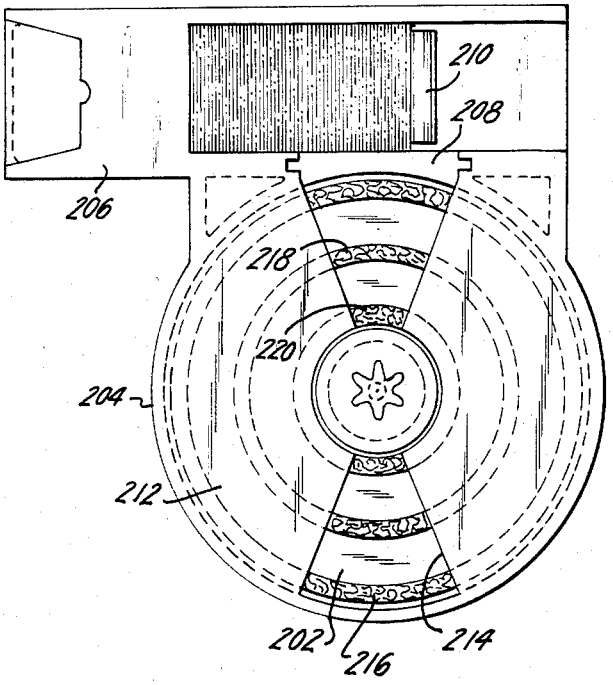
Figure 8:
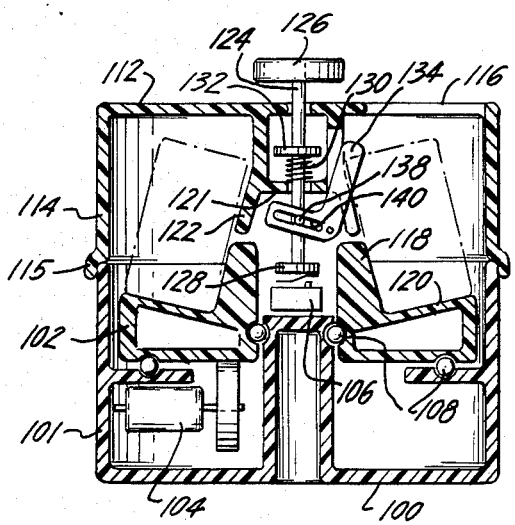
Figure 9:
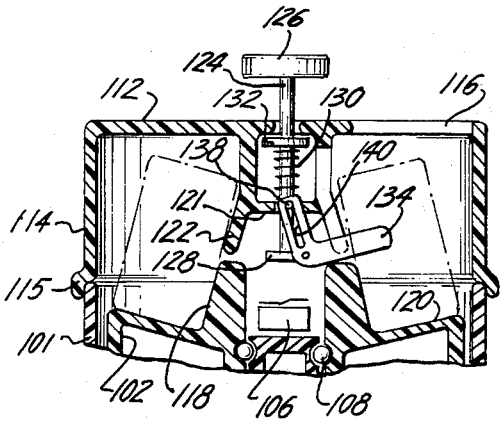
Figure 10:
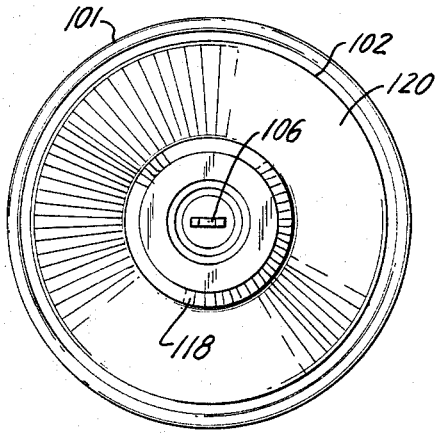
Figure 11:
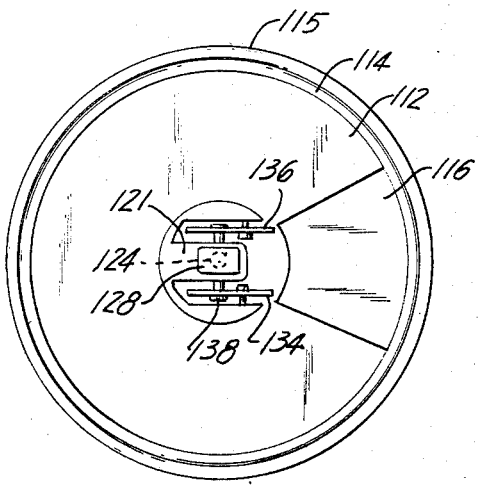

This invention pertains to a device by which predictability can be reduced, thereby improving games of chance.

Certain card games such as "blackjack" utilize a distinctive type of deal in which each round of play utilizes cards from a stack of unplayed cards which may consist of several decks. Played cards are collected after every round of play but are not immediately returned to play. Rather they are segregated and returned to play only after a substantial number of such played cards have been collected. As a result, it is possible, by keeping track of the cards which have been played, to approximate the odds on the values of the remaining unplayed cards, giving rise to a variety of "counting systems" by which certain individuals can greatly increase their odds of winning.

With the advent of legalized gambling, casinos are faced with a dilemma. One one hand, counting lowers the win rate by decreasing the number of hands dealt to non-counter customers and drains profits needed to justify the casino's substantial investment. On the other hand, efforts at detecting and barring counters are not only time consuming and expensive in the training and diversion of personnel but also potentially risky to the image of the casino should a good patron be barred on a mistaken suspicion that he is a counter. There is also a general feeling of unfairness in barring persons from an establishment otherwise open to the public simply because he or she is "too good". Consequently, efforts have been directed at finding means by which the advantages of counters over other players can be minimized or at least diminished.

The present invention is based on a novel device by which the predictability of unplayed cards, and thus the counter's advantage, can be reduced without affecting the general player's enjoyment.

REFERRING TO THE DRAWINGS

FIG. I is top view of a random card generator according to the present invention with a portion cut away to reveal the interior thereof;

FIG. II is a cross-section view of the device shown in FIG. I taken along lines 2—2 of FIG. I;

FIG. III is a cross-section view of the device shown in FIG. I taken along lines 3—3 of FIG. I;

FIG. IV is a perspective view of the gate means utilized in the embodiment of FIGS. I–III;

FIG. V is a top view of a second embodiment of the present invention;

FIG. VI is a cross-section view of the device shown in FIG. V taken along lines 6—6 of FIG. V;

FIG. VII is a perspective view of spacer means utilized in conjunction with the embodiment shown in FIGS. V and VI;

FIG. VIII is a cross-section of a third embodiment of the present invention having a cover portion having spacer means integral therewith and its associated base portion;

FIG. IX is a partial cross-section of the embodiment of FIG. VIII with however spacer means fully extended;

FIG. X is a top view of the base portion shown in FIG. VIII; and

FIG. XI is a bottom view of the cover portion shown in FIG. VIII with however spacer means fully retracted.

FIG. XII is a top view of a fourth embodiment of the present invention.

Referring to the drawings in detail, the random card generator shown in FIGS. I–IV includes a base 10, including cylindrical wall 11. Mounted on base 10 is a continuous track 12. The track includes means operable to support a plurality of playing cards in a vertical orientation; i.e., on either of the card's long or short edge. These means can comprise a low shoulder 14 defining a plurality of slits 16. (Alternative support means are discussed below). Track 12 is rotatably mounted on base 10, as for example, on ball bearings 18, or by any equivalent bearing means.

Associated with base 10 is a cover 20 which preferrably is removable. Base 10 and cover 20 are designed so as to define an inner chamber 22 housing track 12 and a plurality of the vertically oriented playing cards so that track 12 (and its cards) can rotate freely therein.

Means for effecting such rotation can include knob 24 extending upwardly from track 12 on hub 25 through cover 20.

Associated with one or both of the cover and base are one or more access means which define an access station. Such access means permit either or both of removal of cards from or insertion of cards onto that portion of the track which is aligned with the access station.

In the embodiment of FIGS. I–IV, a dealing shoe 26 is integral with base 10, and the access station is defined by a sectorially shaped opening defined in cover 20 and a corresponding opening in wall 11. There is also provided a gate 28 (see FIGS. I, III and IV) which includes a sectorially shaped portion 30, a concave portion 32, each of which corresponds to the opening of the access station, and back plate 34 constituting the rear portion of shoe 26. Gate 28 may be provided with handle 36 or other suitable grasping means. There may also be a cylindrical roller 28 associated with shoe 26, which may be sloped downwardly towards its dealing end, roller 28 thereby urging cards 40 towards the dealing of shoe 26.

In practice a number of decks of cards, as for example from 4 to 20, are thoroughly shuffled. Gate 28 is removed and the cards are aligned vertically and radially on track 12. A portion of the cards can also be placed in dealing shoe 26, optionally with placement of a "cut" card. Gate 28 is replaced and play initiated in the usual fashion. At some subsequent point, either when the "cut" card is reached or after a predetermined number of deals, the played cards are shuffled. Gate 28 is removed and a portion of unplayed cards roughly approximate in number to the played cards, is manually transferred from that area of track 12 which is aligned with the access station to shoe 26 (with replacement of the cut card). The shuffled played cards are then returned to the track, the gate reinserted and the track rotated an arbitrary distance. Play is then resumed and the procedure repeated at a subsequent point; e.g., upon next reaching the "cut" card or after the predetermined number of deals. It will be readily appreciated that after such cycles it would be fruitless for an individual to attempt to count cards since the cards in the shoe are a random portion of numerous decks, some of which cards may have already been played previously and some of which may not have been played.

Referring now to FIGS. V–VII, there is depicted a second embodiment of the present invention comprising base 50 having a cylindrical wall portion 51 and within which is rotatably mounted continuous track 52. In this embodiment, track 52 is electrically rotated by motor 54 which communicates with a suitable reduction means 56. The motor may be activated and deactivated by manual switch means (not shown) or by independent switch means so that track 52 is rotated on bearings 58 in arbitrary increments.

Cover 60 includes a top portion 62 and cylindrical wall portion 64, the latter mating with wall portion 51 of base 50. Defined in the cover top portion 62 is an access station 66 by which cards can be introduced or removed. In contrast to the first embodiment discussed above, in which the track has a planar base portion and a cylindrical central hub, a conical centrally raised hub 68 slopes downwardly and outwardly from the axis of rotation to an inwardly sloping floor portion 70 corresponding to the inner surface of a cone. The intersection of a plane passing through the axis of rotation with the outer surface of the hub will be perpendicular with the intersection of the same plane with the upper surface of the floor portion. When a sufficient number of cards are placed on this track, they will be maintained in the required vertical alignment.

Also associated with this embodiment are removal spacer means 72 which both determines the number of unplayed cards to be removed and maintains the remaining unplayed cards in their vertical orientation after removal of the former. Spacer means 72 includes a back portion 74 which has a curve concentric to wall 51 (and which thus can slip between wall 51 and the outwardmost portion of all cards on track 52), dividers 76 and 78 which are radial to the curve of back portion 74, and handle portion 80 by which spacer means 72 can be inserted and removed. Although spacer means can be of unitary construction so that dividers 76 and 77 define a fixed segment, it is often desirable to permit adjustment of the angle defined by the dividers. This can be accomplished, for example, as shown in the depicted embodiment, by a curved portion 82 extending on divider 78 which is slideable mounted in back portion 74. In this manner it is possible to adjustably vary the number of cards which will be partitioned by the spacer means.

In practice, a sufficient number of decks to fill the embodiment of FIGS. V–VII and a conventional dealing shoe (not shown) are shuffled and play is conducted from the shoe in the usual fashion. When a predetermined number of cards have been played, spacer means 72 is inserted into the device through access station 66, thereby delineating a given number of unplayed cards to be removed. When this portion of unplayed cards has been removed and placed in the shoe, the played cards [resting in, for example, a discard rack (not shown)] can be resubstituted in their stead in the present device between dividers 76 and 78. Spacer means 72 is then removed. Subsequent rotation of track 52 will bring a different group of cards (which may or may not have been previously played) in alignment with access station 66 and the process then repeated at the predetermined subsequent time.

A further variation is shown in FIGS. VIII–XI. Base 100 has a cylindrical wall portion 101 within which is rotatably mounted continuous track 102. As in the embodiment of FIGS. V–VII, track 102 is electrically rotated by motor 104 which is activated by independent switch means 106 so that track 102 is rotated on bearings 108.

Cover 110 includes a top portion 112 and cylindrical wall portion 114 and lip 115, the latter mating with wall portion 101 of base 100. Defined in the cover top portion 112 is an access station 16 by which cards can be introduced or removed. As in the case of the embodiment of FIGS. V–VII discussed above, a conical centrally raised hub 118 slopes downwardly and outwardly from the axis of rotation to an inwardly sloping floor portion 120 corresponding to the inner surface of a cone. Unlike the embodiment of FIGS. V–VIII, hub 118 does not extend to the area of cover portion 112 but terminates and is met by spacer housing 122 which is an extension of cover portion 112. This does not rotate and presents a lower conical cross-section of a slightly less diameter than that of hub 118. Slideably mounted within bushing 121 of housing 122 is plunger 124 which terminates at one end in handle 126 and at the other in switch shoe 128. Spring means 130 urges plunger 124 upwards and away from switch 106, the upward sliding motion being arrested by stop 132. Switch 106 is normally open and is closed (for activation of motor 104 and rotation of track 102) upon full depression of plunger 124.

Pivotably mounted on spacer housing 122 are dividers 134 and 136 which in turn engage link 138 on plunge 124 through slot 140. The linkage is arranged so that when plunger 124 is fully extended, as in FIG. IX, dividers 134 and 136 are also fully extended between a portion of cards on track 102 whereas when plunger 124 is fully depressed, dividers 134 and 136 are fully retracted within housing 122, as shown in FIG. XI. The device should be self-braking, i.e., as soon as shoe 128 ascends to the point that switch 106 is open, rotation of track 102 ceases and dividers 134 and 136 begin to extend downwardly to separate a portion of the cards.

At the time dividers 134 and 136 begin to extend approximately the position shown in FIG. VIII, the cards will be radially disposed on track 102. Because of their parallel relationship, the extension of dividers 134 and 136 (to approximately the position shown in FIG. IX) will herd the cards between the dividers into a discrete, roughly rectangular group, thereby facilitating easy removal. Analogously to adjustable spacer 72 in FIGS. V–VII, means can be provided for adjusting the distance between spacers 134 and 136 so that the number of cards which they separate can be varied.

The embodiment of FIG. XII is similar to that of FIGS. I–III in the configuration of track 202 rotatably mounted on a base 204. However, in this embodiment shoe means 206 is disposed tangentially to the track. Gate means 208 is vertically removable so as to define a first access station, in this case for removal of unplayed cards and transferral to shoe 206. A roller 210 is associated with shoe 206 (which can be moved to the rear of the shoe when this transfer is made).

In addition, cover 212 is also provided with a second access means 214 by which played cards can be returned to the device, either in a group of by lacing the same between unplayed cards already in the device. In order to encourage maintenance of the cards in a vertical orientation, the floor of track 202 can be provided with one or more strips of a pile material (of which three, 216, 218 and 220 are shown in FIG. XII) into which the cards nest.

It will be immediately apparent to those skilled in the art that numerous variation and modification of the invention are possible without departing from the spirit thereof. The present specification thus presents typical embodiments of how to make and use the invention but is in no sense a limitation thereof, the invention being defined solely by the claims which follow.

What is claimed is:

1. A device for maximizing the random distribution of a plurality of playing cards, said device comprising a base, a continuous, advancable, circular track rotatably mounted on said base, means disposed on said track operable to support a plurality of unpartitioned cards only at their edge portions radially on said track with their major surface in a vertical orientation, and a cover associated with said base, said base and cover operable cooperatively to enclose said track and cards supported thereon, and said cover further defining at least one sectorially shaped access station permitting either or both of manual removal of an arbitrary number of the cards on that segmental region of the track then aligned with the access station or manual insertion of cards into that segmental region of the track then aligned with the access station.

2. A device according to claim 1 wherein said track is defined by a central raised hub which is symmetrical about its vertical axis and a coaxial circular floor portion extending from the lower portion of said hub, the intersection of (i) a plane passing through said axis and (ii) the outer surface of said hub being perpendicular to the intersection of (i) the same plane and (ii) the upper surface of said floor portion.

3. The device according to claim 2 wherein said floor is concave and defines the inner surface of a cone sloping inwardly towards said axis, and the outer surface of said hub is conical and slopes in a downwardly direction from said axis to said floor portion.

4. The device according to claim 2 wherein said floor portion is planar and said hub is cylindrical.

5. The device according to claim 4 wherein said cover comprises an outer side wall portion and a top portion and the access station is defined on said top portion and extends down said side wall portion.

6. The device according to claim 5 including gate means operable to close said access station when not in use.

7. The device according to claim 6 wherein said access station communicates through said side wall portion with a card dealing shoe.

8. The device according to claim 7 wherein a second access station operable to permit insertion of cards is defined in said cover.

9. A device for maximizing the random distribution of a plurality of playing cards, said device comprising a base, a continuous, advancable, circular track rotatably mounted on said base, means operable to vertically support a plurality of cards only at their edge portions in radial orientation on said track, a cover associated with said base, said base and cover operable cooperatively to enclose said track and cards supported thereon, said cover further defining at least one sectorially shaped access station permitting either or both of removal of an arbitrary number of the cards on that segmental region of the track then aligned with the access station or insertion of cards into that segmental region of the track then aligned with the access station, movable spacer means operable in a first, interposed position to segregate a portion of cards aligned with the access station and to maintain the remaining cards vertically on the track in their radial orientation, and means operable to move said spacer means to a second, noninterposed position in which said track can be advanced to a new position.

10. A device according to claim 9 wherein said spacer means are adjustable so that the portion of cards being segregated can be varied.

11. A device according to claim 9 wherein said spacer means are movably mounted on the device for movement between said first and second position.

12. A device according to claim 11 wherein said spacer means are pivotably mounted in a housing extending downwardly from said cover.

13. A device according to claim 9 wherein said spacer means are shaped for insertion onto said track through said access station and manually removable therefrom.

14. The method of reducing the predictability in card games in which each successive round of play utilizes cards from a group of unplayed cards while played cards ae segregated and not returned to the group after each round of play, which method comprises:

(a) maintaining at least a portion of unpartitioned unplayed cards with their major surface in a vertical, radial orientation about a continuous, advancable, circular track said track having a cover, in said cover is defined at least one sectorially shaped access station;

(b) periodically manually removing a fraction of said unplayed cards from arbitrary segmental regions of said track through one of said access stations;

(c) utilizing the fraction of unplayed cards removed from said track for subsequent play; and (d) manually returning played cards to an arbitrary segmental region of said track through one of said access stations after a plurality of rounds of play.

15. The method of claim 14 wherein said played cards are returned to that region of the track from which said fraction of unplayed cards is removed.

16. The method of claim 14 wherein said played cards are returned to a region of the track different from that at which said fraction of unplayed cards is removed.

* * * * *